US005873764A

United States Patent [19]

Scherr

[11] Patent Number: 5,873,764

[45] Date of Patent: Feb. 23, 1999

[54] SIDE EVACUATING BALLOON INFLATER

[76] Inventor: Mark J. Scherr, 14720 W. Honey La., New Berlin, Wis. 53151

[21] Appl. No.: 41,395

[22] Filed: Mar. 12, 1998

[51] Int. Cl.[6] ..... A63H 3/06; B65B 1/04; B65B 43/26; B65B 31/04

[52] U.S. Cl. ..... 446/220; 53/469; 53/570; 53/386.1; 141/65; 141/114

[58] Field of Search ..... 446/220, 222, 446/224; 53/452, 459, 469, 483, 570, 261, 262, 385.1, 386.1, 390, 403, 410; 141/8, 10, 65, 114

[56] References Cited

U.S. PATENT DOCUMENTS

| | | | |
|---|---|---|---|
| 3,798,870 | 3/1974 | Kanner et al. | 53/459 X |
| 4,642,065 | 2/1987 | Whedon et al. | 446/209 |
| 4,924,919 | 5/1990 | Oyler . | |
| 4,974,393 | 12/1990 | Rich et al. | 53/469 X |
| 5,016,428 | 5/1991 | Helling et al. | 53/403 |
| 5,033,256 | 7/1991 | Rupp | 53/570 |
| 5,035,104 | 7/1991 | Helling et al. | 53/459 X |
| 5,205,109 | 4/1993 | Conway . | |
| 5,322,101 | 6/1994 | Scherr et al. | 53/385.1 X |
| 5,337,540 | 8/1994 | Carroll . | |
| 5,477,664 | 12/1995 | Carroll . | |
| 5,588,896 | 12/1996 | Goodman | 446/220 X |

*Primary Examiner*—Robert A. Hafer
*Assistant Examiner*—D. Neal Muir
*Attorney, Agent, or Firm*—Donald J. Ersler

[57] ABSTRACT

A side evacuating balloon inflater includes a lower shell, an upper shell, a collar insert, and a check valve. The lower shell is sealed to the upper shell with a gasket. A collar insert is slid into an inner diameter of a bore that is disposed on the top of the upper shell. A plurality of nubs are spaced around the collar insert. A balloon is stretched over the nubs and is retained thereby. A tapered boss surrounds the check valve which is disposed in the shell structure. The tapered boss facilitates the sealing of different size vacuum tubes to the shell structure. A household vacuum cleaner or a shop vacuum is used to pull a vacuum on the shell structure. The vacuum causes the balloon to stretch to the inside wall of the shell structure. The vacuum tube is removed and the check valve retains the vacuum inside the shell structure. Novelty items may be inserted into the mouth of the balloon; the balloon is then be sealed with a clip.

27 Claims, 6 Drawing Sheets

SIDE EVACUATING BALLOON INFLATER

BACKGROUND OF THE INVENTION

1. Field of the Invention

The present invention relates generally to balloon inflaters and more specifically to a side evacuating balloon inflater which is less complicated and more cost effective than prior art balloon inflaters.

2. Discussion of the Prior Art

Balloon inflaters facilitate the insertion of novelty items inside a large balloon. The balloon is then sealed with the novelty items contained therein. The drawback to most prior art balloon inflaters is the inclusion of an expensive vacuum unit used to create a vacuum inside the balloon chamber of the balloon inflater. The vacuum unit is specially manufacturer for the balloon inflater and will not work without it. If the vacuum unit fails, the consumer must buy the vacuum unit from the manufacturer at a very high cost. The special vacuum unit also increases the total cost of the balloon inflater.

A second drawback to most prior art balloon inflaters is the inflexibility of one collar size. If it is better to use a four inch collar instead of a five inch collar, then the consumer will have to buy a smaller size balloon inflater.

Accordingly, there is a clearly felt need in the art for a side evacuating balloon inflater which allows an inexpensive vacuum device to draw a vacuum on a balloon chamber, can be manufactured for a lower cost, and allows different collar diameters to be used for different balloon sizes.

SUMMARY OF THE INVENTION

The primary objective of the present invention is to provide a side evacuating balloon inflater which allows an inexpensive vacuum device to draw a vacuum on a balloon chamber, can be manufactured for a lower cost, and allows different collar diameters to be used for different balloon sizes.

According to the present invention, a side evacuating balloon inflater includes a lower shell, an upper shell, a collar insert, and a check valve. A top edge of the lower shell has a lower flange extending from the circumference thereof. A bottom edge of the upper shell has a lip flange extending from the circumference thereof. The lower flange fits inside the lip flange and locates the lower shell relative to the upper shell. A gasket is inserted between the lower flange and the upper flange to form a seal therebetween. The assembly of the lower shell, upper shell and gasket forms a shell structure.

A boss extends upward from a top of the upper shell. The inside of the boss is sized to receive a collar insert. A groove is formed at substantially the first end of the collar insert to receive an o-ring. The o-ring will form a seal between the inside diameter of the collar and the first end of the collar insert. The collar insert has a rim and a plurality of radial nubs which extend perpendicular outward at a second end. A flat spot is molded on the rim to allow a large balloon to be easily rolled off the rim and the plurality of radial nubs. The collar insert diameter at the second end may be fabricated to any suitable size to accommodate different balloons sizes.

The upper and lower shells have at least one air relief which extends from the top to the bottom thereof and protrudes from the outer surface. It is preferable that the check valve be disposed on the center of an air relief to provide an efficient evacuation of the shell structure. It is preferable that a tapered boss surrounds the check valve. The tapered boss is preferable because it will accommodate different diameters of vacuum tubes. A household vacuum cleaner is sufficient to inflate a balloon in the shell structure.

Accordingly, it is an object of the present invention to provide a side evacuating balloon inflator which does not require an expensive vacuum unit to operate thereof.

It is a further object of the present invention to provide a side evacuating balloon inflator which is less costly to manufacture than the prior art.

It is yet a further object of the present invention to provide a side evacuating balloon inflator which is structured to allow different size collar diameters to be used.

Finally, it is another object of the present invention to provide a side evacuating balloon inflator which has at least one air relief which allows a more efficient evacuation of the air inside the shell structure.

These and additional objects, advantages, features and benefits of the present invention will become apparent from the following specification.

DETAILED DESCRIPTION OF THE PREFERRED EMBODIMENTS

Figure 1:
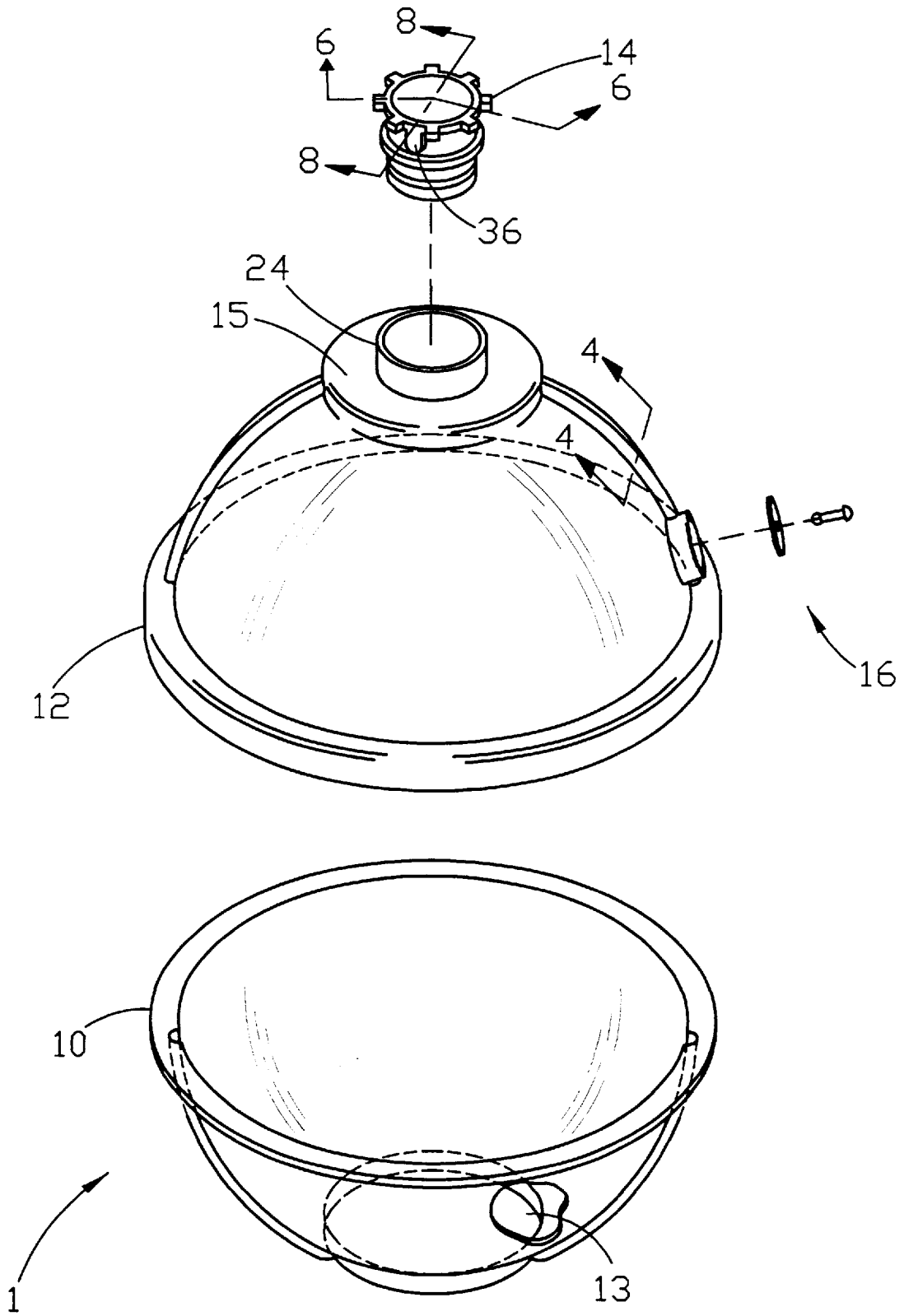
FIG. 1 is an exploded perspective view of a side evacuating balloon inflater in accordance with the present invention.
Figure 2:
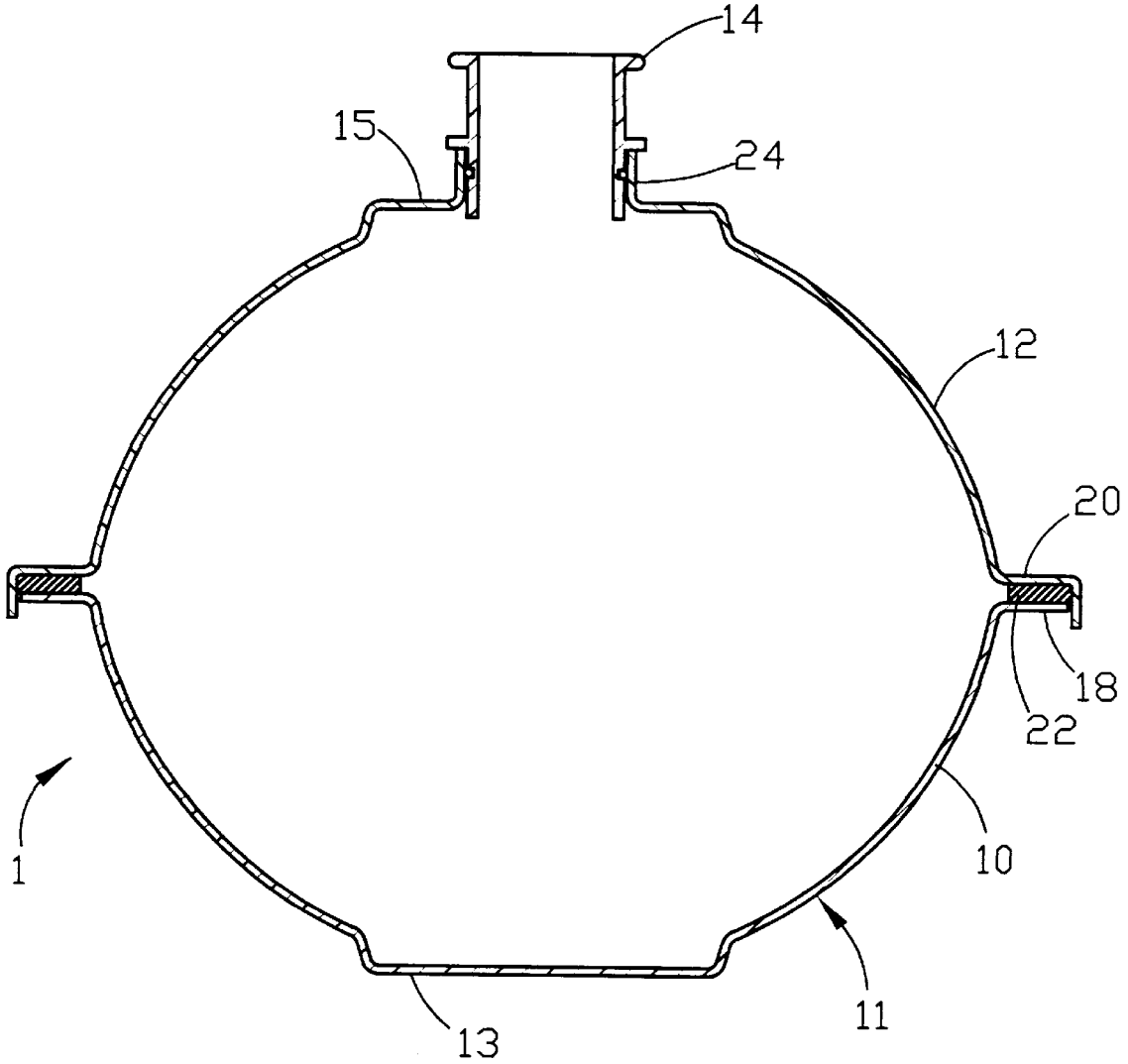
FIG. 2 is a cross sectional view of an assembled side evacuating balloon inflater in accordance with the present invention.
Figure 3:
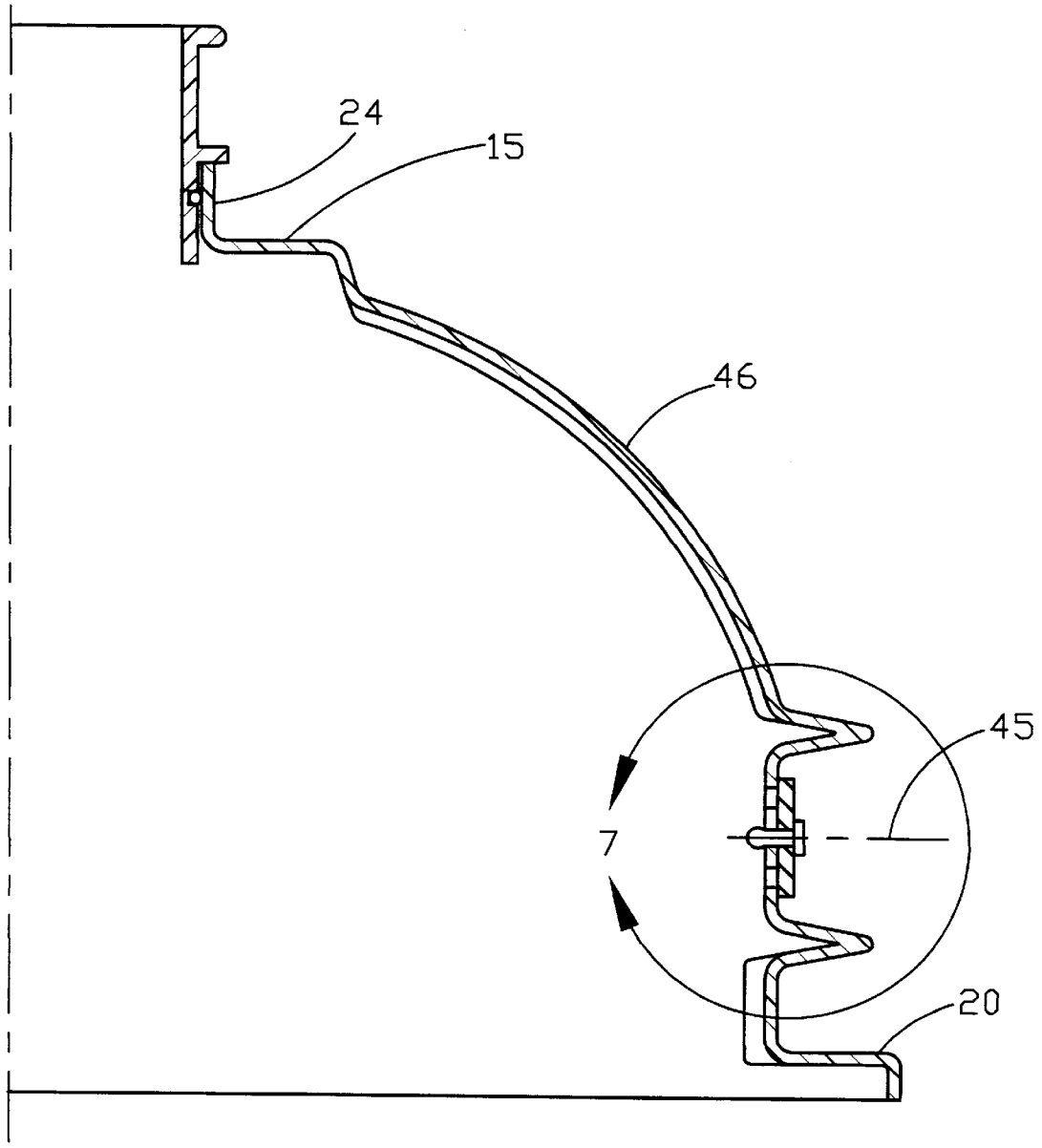
FIG. 3 is a partial cross sectional view of a side evacuation balloon inflater with a check valve in accordance with the present invention.

With reference now to the drawings, and particularly to FIG. 1, there is shown a exploded perspective view of a side evacuating balloon inflater 1. The side evacuating balloon inflater 1 includes a lower shell 10, an upper shell 12, a collar insert 14, and a check valve 16. With reference to FIG. 2, a cross sectional view of an assembled side evacuating balloon inflater 1 is shown. A shell structure 11 includes the lower shell 10 sealed against the upper shell 12.

A top edge of the lower shell 10 has a lower flange 18 which extends outward from the circumference thereof. A lower flat spot 13 is formed on a bottom of the lower shell 10. The lower flat spot 13 provides stability to the shell structure 11. A bottom edge of the upper shell 12 has a lip flange 20 which extends outward from the circumference thereof. An upper flat spot 15 is formed in a top of the upper shell 12. The upper flat spot 15 provides an improved seal between an inflated balloon and the upper shell 12. The lower flange 18 fits inside the lip flange 20 and locates the lower shell 10 relative to the upper shell 12. A gasket 22 is attached to the inside of the lip flange 20. When the upper shell 12 is placed on the lower shell 10 the gasket 22 forms a seal.

Figure 6:
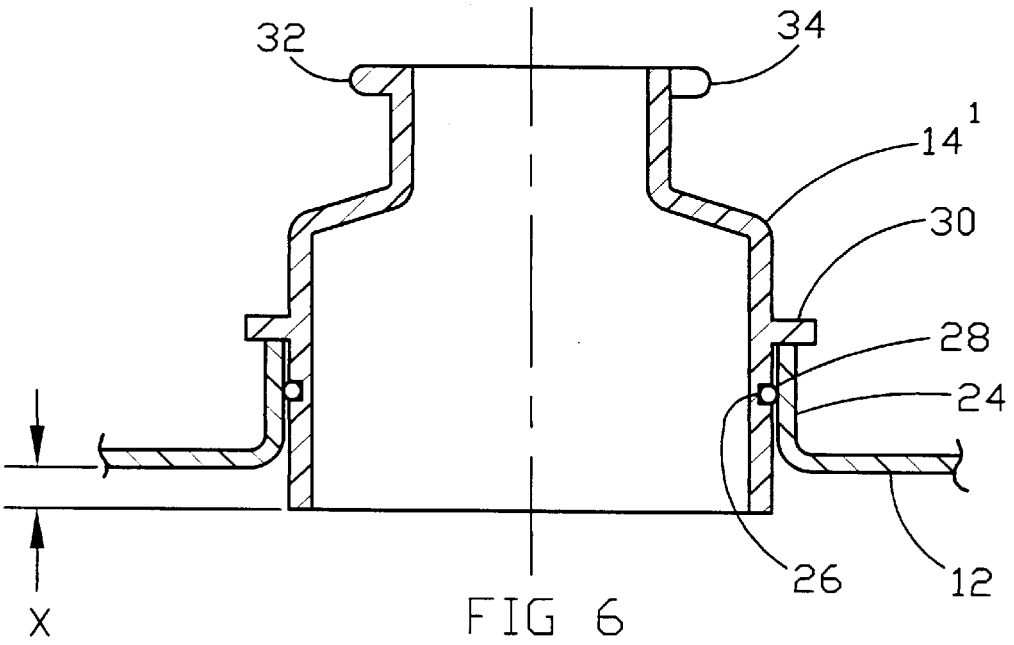
FIG. 6 is a cross sectional view of a collar insert which is disposed inside a bore of an upper shell in accordance with the present invention.

With reference to FIG. 6, a boss 24 extends upward from the top of the upper shell 12. The boss 24 has an inside diameter which sized to slidably receive a collar insert 14'. The collar insert 14' is the same as the collar insert 14 with the exception that the outer diameter of the second end is necked to a smaller outer diameter than the first end. Using a collar insert instead of a one piece collar provides the flexibility of differing outer diameters for different size balloons. It is also possible to make the collar insert 14 as an integral piece of the upper shell 12. A groove 26 is formed at substantially the first end of the collar insert 14. An o-ring 28 is rolled into the groove 26. The collar insert is then slid into the inner diameter of a bore 24 which is preferably disposed in the upper shell 12. The o-ring 28 forms an air tight seal between the atmosphere and the inside of the shell structure 11 (when a balloon is fastened to the second end of the collar insert 14'). The first end of the collar insert 14' protrudes below the bore 24 by a dimension x, as shown in FIG. 6. Dimension x is preferably one half inch, for all sizes of collar inserts.

Figure 9:
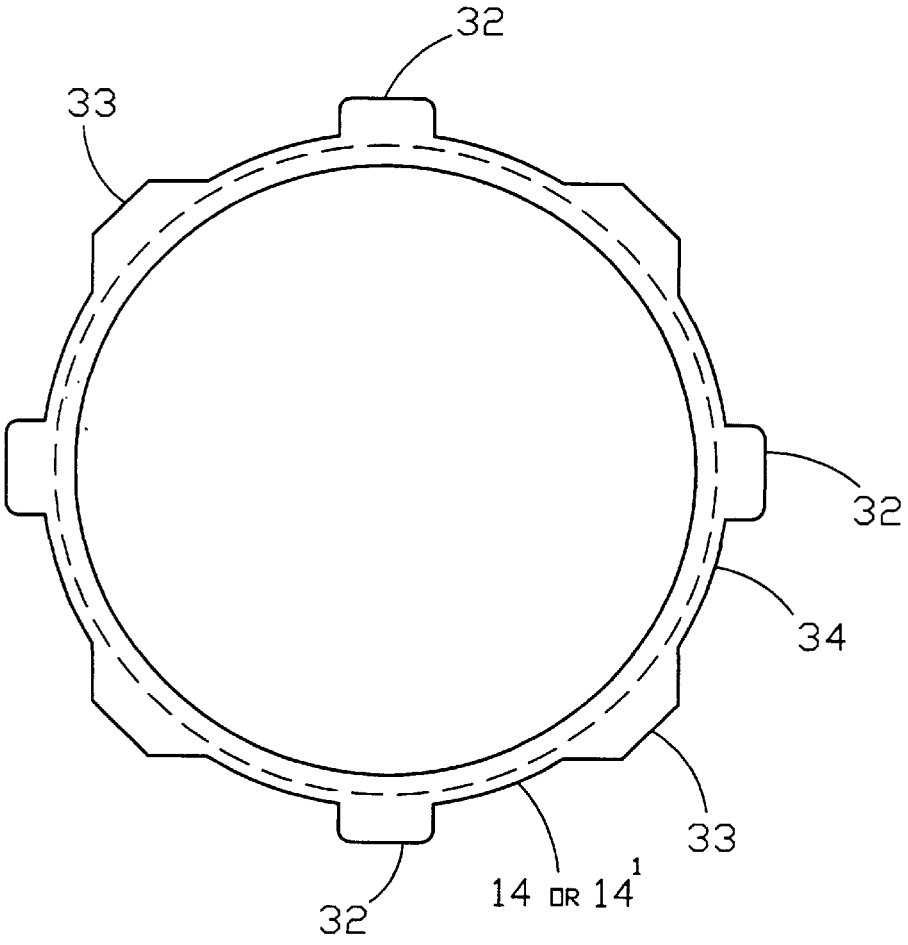
FIG. 9 is an enlarged top view of the collar insert in accordance with the present invention.
Figure 8:
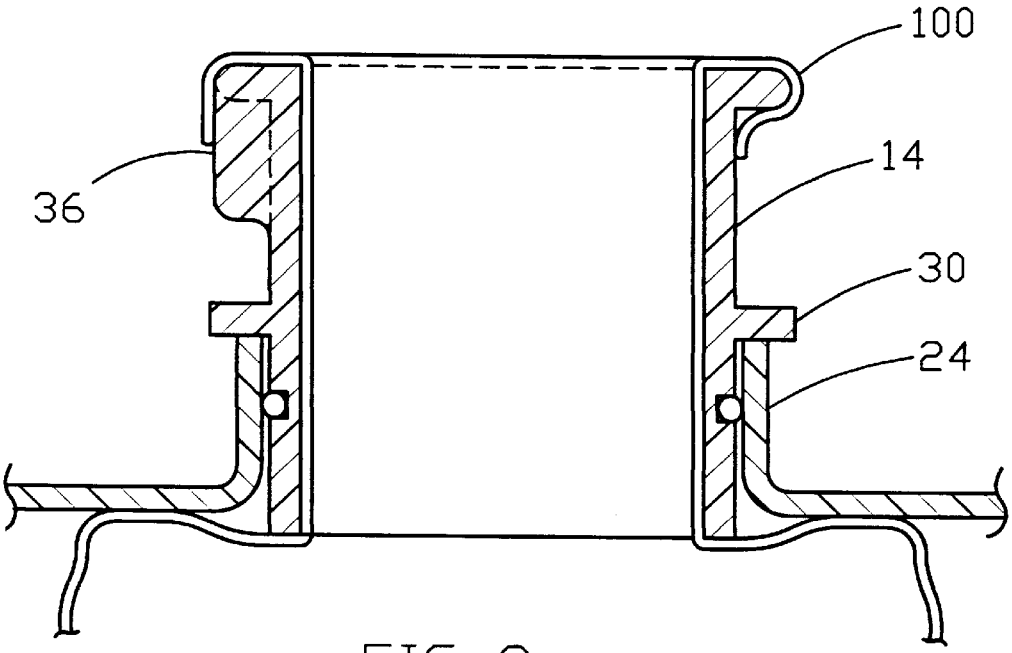
FIG. 8 is a cross sectional view of a balloon stretched over a collar insert in accordance with the present invention.

A flange 30 extends radially outward from the collar insert 14' at substantially the middle thereof. The flange 30 prevents the collar insert 14' from being pushed through the inner diameter of the bore 24. With reference to FIG. 9, a square nub 32 extends radially outward from the collar insert 14' at a second end thereof. Square nubs 32 are preferably perpendicular to each other. Angled nubs 33 are tapered in shape to facilitate withdrawal of the collar insert 14 or 14' from a mold during a blow molding operation. Both the square nubs 32 and the angled nubs 33 are under cut to retain a balloon which is stretched over the circumference of the second end of the collar insert 14 in FIG. 8. It is preferable to use eight nubs as opposed to six as is common in the prior art devices. It is easier to divide a balloon opening in half than into thirds.

A rim 34 extends around the circumference of the second end of the collar insert 14'. The undercut shape of the rim 34 provides extra retention for a stretched balloon 100. A flat spot 36 is molded on to the outer diameter of the collar insert 14 at a second end in FIG. 8. The flat spot 36 is flush with the rim 34 and allows the stretched balloon 100 to be easily rolled off the second end of the collar insert 14.

Figure 5:
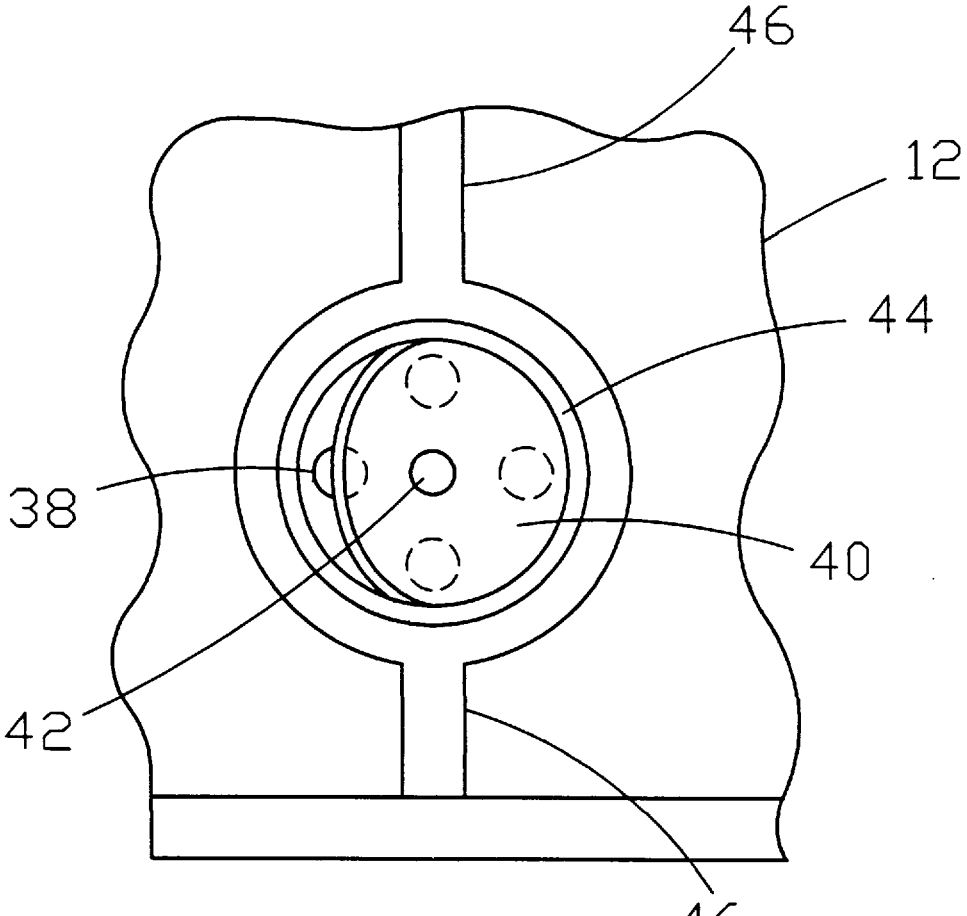
FIG. 5 is a front view of a check valve in accordance with the present invention.
Figure 7:
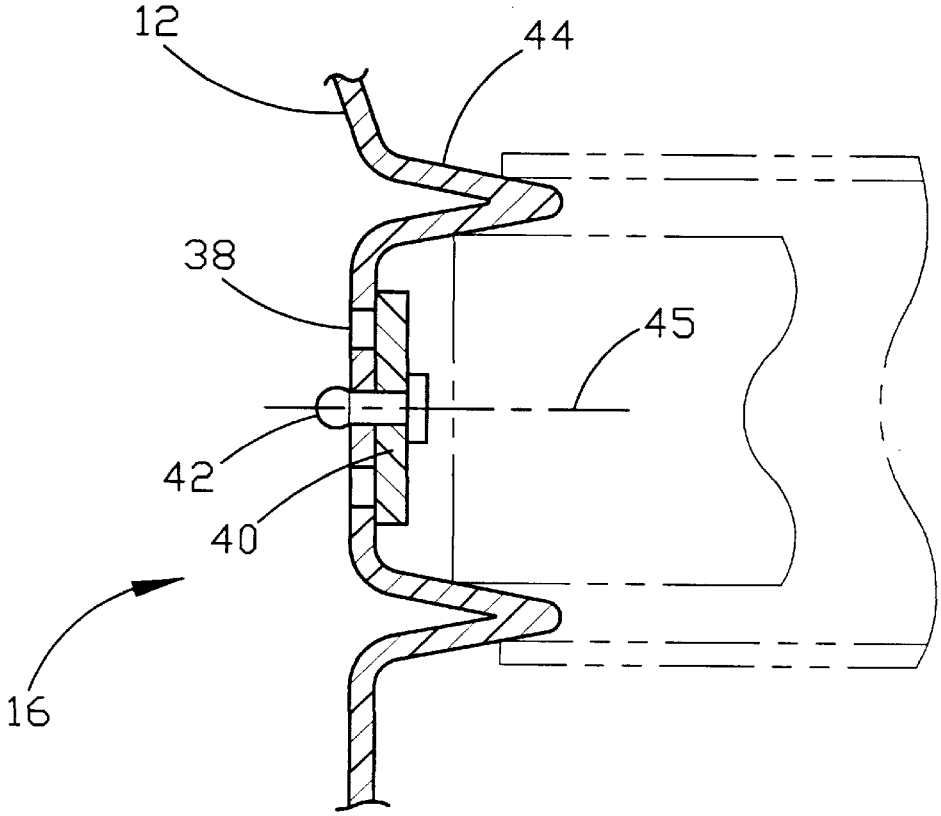
FIG. 7 is an enlarged cross sectional view of the check valve in accordance with the present invention.

FIGS. 5 and 7 show a front view and an enlarged view of a check valve 16, respectively. The check valve 16 includes at least one vacuum hole 38, a flap 40, and a retainer 42. The retainer 42 is inserted through the flap 40 and a hole preferably in the upper shell 12 to retain the flap 40 against the side of the shell structure 11. The flap 40 covers at least one vacuum hole 38. A tapered boss 44 is preferably molded in the upper shell 12, around the check valve. The tapered boss 44 allows different size tubes (as shown in phantom line) of a vacuum source to be used to place a vacuum on the interior of the shell structure 11. The tapered boss 44 may be disposed in the side of either the upper shell 12 or the lower shell 10. The tapered boss 44 may also be disposed in the top flat spot 15 of the upper shell 12. If the shells are formed by a blow molding process, it is necessary that the center line 45 of the tapered boss 44 be either horizontal or vertical to allow withdrawal from the blow mold. The tapered boss 44 may be tapered on the inside only or on both the inside and the outside surfaces as shown in FIG. 7. The flap 40 is preferably fabricated from rubber and the retainer of a plastic material.

In operation, the tube of a simple vacuum source such as a household vacuum cleaner may be used to draw a vacuum on the shell structure 11. The flap 40 is flexible enough to uncover at least one vacuum hole and allow a vacuum to be drawn inside the shell structure 11. When the vacuum source is turned off, the flap 40 is pulled against at least one vacuum hole by the force of the vacuum inside the shell structure 11.

It is well known in the art that placing a balloon inside a sealed chamber and drawing a vacuum on the inside of the chamber causes a balloon to inflate outward to the inside walls of the chamber. Once the balloon is stretched under vacuum, objects may be inserted into the mouth of the stretched balloon. The stretched balloon end is then rolled off the second end of the collar insert 14 at the flat spot 36. The mouth of the balloon is then easily sealed with a clip or any suitable sealing device. In operation, a simple vacuum source could be a household vacuum cleaner, or a shop vacuum cleaner.

Figure 4:
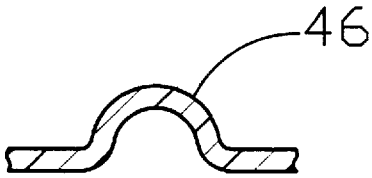
FIG. 4 is a cross sectional view of an air relief in an upper shell in accordance with the present invention.

FIG. 4 shows a cross sectional view of an air relief 46 which may be formed in the wall of either the upper shell 12 or the lower shell 10. The air relief 46 is preferably formed into the semi-circular cross section as shown to facilitate easy withdrawal from a mold. In the upper shell 12, the air relief 46 originates at substantially the top of the upper shell 12 and continues down to the tapered boss 44. The air relief 46 also extends between the tapered boss 44 and the lip flange 20. The air relief 46 may also be formed in the wall of the lower shell 10 from the lower flange 18 to the bottom thereof. It is preferable that two air reliefs 46 be formed in the lower shell 10 and the upper shell 12. The two air reliefs are preferably spaced 180 degrees apart from each other. The air relief 46 allows air to be evacuated from the shell structure 11 in a more efficient fashion.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A side evacuating balloon inflater comprising:

a lower shell with formation defining a bottom;

an upper shell being placed on said lower shell and forming a shell structure;

a check valve being formed in said shell structure displaced away from said bottom; and a boss having sides which are tapered, said boss being molded around said check valve, said boss being sized to seal either an inner or an outer diameter of a vacuum source tube.

2. The side evacuating balloon inflater of claim 1, further comprising:

a collar insert having a first end, a second end, and being sized to be received by an inner diameter of a boss.

3. The side evacuating balloon inflater of claim 2, further comprising:

an o-ring; and said collar insert having an o-ring groove sized to receive said o-ring, said o-ring forming an air tight seal between the atmosphere and the inside of the shell structure when a balloon is stretched over said second end of said collar insert.

4. The side evacuating balloon inflater of claim 2, wherein:

a rim being formed at said second end of said collar insert; and at least two square nubs being formed on said rim, said rim and said at least two square nubs retaining the stretched mouth of a balloon.

5. The side evacuating balloon inflater of claim 4, wherein:

at least two angled nubs being formed on said rim, each said angled nub being spaced between two square nubs, the shape of each said angled nub allowing the efficient removal from a mold.

6. The side evacuating balloon inflater of claim 2, wherein:

a flat spot being formed flush with said rim, said flat spot facilitating the efficient rolling of a stretched balloon mouth off said second end of said collar insert.

7. The side evacuating balloon inflater of claim 1, further comprising:

said check valve having a flap and a retaining pin;

at least one vacuum hole being formed in said shell structure; and said flap covering said at least one vacuum hole, said retaining pin being inserted through said flap and said shell structure, said flap being retained against said shell structure thereby.

8. The side evacuating balloon inflater of claim 1, further comprising:

a gasket;

said lower shell having a lower flange which extends outward from said circumference at a top thereof;

said upper shell having a lip flange which extends outward from said circumference a bottom thereof, said lip flange fitting over said lower flange, said lower shell being located in relation to said upper shell; and said gasket being inserted between said lower flange and said upper flange, said gasket sealing said lower shell to said upper shell.

9. The side evacuating balloon inflater of claim 1, wherein:

at least one air relief channel being molded into the wall of said lower shell; and at least one air relief channel being molded into the wall of said upper shell.

10. The side evacuating balloon inflater of claim 1, wherein:

an upper flat spot being formed at a top of said upper shell, said flat spot providing improved sealing during the inflation of a balloon.

11. A side evacuating balloon inflater comprising:

a lower shell;

an upper shell being placed on said lower shell and forming a shell structure;

a boss being formed in said shell structure, said boss having an inner diameter;

a collar insert having a first end and a second end, said first end being sized to be received by said inner diameter of said boss;

an o-ring, said collar insert having an o-ring groove sized to receive said o-ring, said o-ring forming an air tight seal between the atmosphere and the inside of the shell structure when a balloon is stretched over said second end of said collar insert;

at least two square nubs being formed on said rim, said rim and said at least two square nubs retaining the stretched mouth of a balloon; and at least two angled nubs being formed on said rim, each said angled nub being spaced between two square nubs, the shape of each said angled nub allowing the efficient removal from a mold.

12. The side evacuating balloon inflater of claim 11, wherein:

a flat spot being formed flush with said rim, said flat spot facilitating the efficient rolling of a stretched balloon mouth off said second end of said collar insert.

13. The side evacuating balloon inflater of claim 11, further comprising:

a check valve being formed in said shell structure.

14. The side evacuating balloon inflater of claim 13, further comprising:

a tapered boss being molded around said check valve, said tapered boss facilitating the sealing between the shell structure and a tube of a vacuum source.

15. The side evacuating balloon inflater of claim 13, further comprising:

said check valve having a flap and a retaining pin;

at least one vacuum hole being formed in said shell structure; and said flap covering said at least one vacuum hole, said retaining pin being inserted through said flap and said shell structure, said flap being retained against said shell structure thereby.

16. The side evacuating balloon inflater of claim 11, further comprising:

a gasket;

said lower shell having a lower flange which extends outward from said circumference at a top thereof;

said upper shell having a lip flange which extends outward from said circumference a bottom thereof, said lip flange fitting over said lower flange, said lower shell being located in relation to said upper shell; and said gasket being inserted between said lower flange and said upper flange, said gasket sealing said lower shell to said upper shell.

17. The side evacuating balloon inflater of claim 11, wherein:

at least one air relief channel being molded into the wall of said lower shell; and at least one air relief channel being molded into the wall of said upper shell.

18. The side evacuating balloon inflater of claim 11, wherein:

an upper flat spot being formed at a top of said upper shell, said flat spot providing improved sealing during the inflation of a balloon.

19. A side evacuating balloon inflater comprising:

a lower shell with formation defining a bottom;

an upper shell being placed on said lower shell and forming a shell structure, said shell structure having at least one air relief channel molded into a wall thereof; and a check valve being formed in said shell structure displaced away from said bottom, said check valve communicating with said at least one air relief channel.

20. The side evacuating balloon inflater of claim 19, wherein:

a rim being formed at said second end of said collar insert; and a plurality of nubs being formed on said rim, said rim and said plurality of nubs retaining the stretched mouth of a balloon.

21. The side evacuating balloon inflater of claim 19, wherein:

an upper flat spot being formed at a top of said upper shell, said flat spot providing improved sealing during the inflation of a balloon.

22. The side evacuating balloon inflater of claim 17, further comprising:

a collar insert having a first end, a second end, and being sized to be received by an inner diameter of a boss.

23. The side evacuating balloon inflater of claim 22, further comprising:

an o-ring; and said collar insert having an o-ring groove sized to receive said o-ring, said o-ring forming an air tight seal between the atmosphere and the inside of the shell structure.

24. The side evacuating balloon inflater of claim 23, wherein:

a flat spot being formed flush with said rim, said flat spot facilitating the efficient rolling of a stretched balloon mouth off said second end of said collar insert.

25. The side evacuating balloon inflater of claim 23, further comprising;

said check valve having a flap and a retaining pin, said check valve being disposed in the center of said tapered boss;

at least one vacuum hole being formed in said shell structure;

said flap covering said at least one vacuum hole, said retaining pin being inserted through said flap and said shell structure, said flap being retained against said shell structure thereby.

26. The side evacuating balloon inflater of claim 23, further comprising:

a gasket;

said lower shell having a lower flange which extends outward from said circumference at a top thereof;

said upper shell having a lip flange which extends outward from said circumference a bottom thereof, said lip flange fitting over said lower flange, said lower shell being located in relation to said upper shell; and said gasket being inserted between said lower flange and said upper flange, said gasket sealing said lower shell to said upper shell.

27. The side evacuating balloon inflater of claim 19, further comprising:

a tapered boss being molded around said check valve, said tapered boss facilitating the sealing between the shell structure and a tube of a vacuum source.

* * * * *